US007093828B2

(12) United States Patent
Murray et al.

(10) Patent No.: US 7,093,828 B2
(45) Date of Patent: Aug. 22, 2006

(54) METHODS AND APPARATUS FOR CLAMPING TOOLS

(76) Inventors: Scott A. Murray, 14368 W. 96th Ter., Lenexa, KS (US) 66215; Sun Xiao Wei, 888 E. Hue Xia Road, YongKang ZheJiang (CN)

( * ) Notice: Subject to any disclaimer, the term of this patent is extended or adjusted under 35 U.S.C. 154(b) by 0 days.

(21) Appl. No.: 10/965,958

(22) Filed: Oct. 18, 2004

(65) Prior Publication Data

US 2005/0082730 A1 Apr. 21, 2005

Related U.S. Application Data

(60) Provisional application No. 60/511,660, filed on Oct. 17, 2003.

(51) Int. Cl.
*B24B 47/021* (2006.01)

(52) U.S. Cl. ..... 269/6; 269/3

(58) Field of Classification Search ..... 269/45, 269/44, 43, 165–168, 249, 3–6
See application file for complete search history.

(56) References Cited

U.S. PATENT DOCUMENTS

| | | | | | |
|---|---|---|---|---|---|
| D162,910 | S | * | 4/1951 | Wallace | D8/354 |
| 2,876,814 | A | | 3/1959 | Leister | |
| 2,947,333 | A | | 8/1960 | Johnson | |
| 3,096,975 | A | | 7/1963 | Irwin | |
| 3,210,070 | A | | 10/1965 | Lagana | |
| 3,357,968 | A | | 12/1967 | Flynn | 269/221 |
| 4,081,170 | A | * | 3/1978 | Doss, Jr. | 251/5 |
| 4,132,397 | A | | 1/1979 | Ward | 269/252 |
| 4,220,322 | A | | 9/1980 | Hobday | 269/6 |
| 4,563,921 | A | | 1/1986 | Wallace | 81/373 |
| 4,786,124 | A | * | 11/1988 | Stone et al. | 359/15 |
| 4,834,354 | A | * | 5/1989 | Yang | 269/156 |
| 4,874,155 | A | | 10/1989 | Goul | 269/6 |
| 4,893,801 | A | | 1/1990 | Flinn | 269/6 |
| 4,926,722 | A | | 5/1990 | Sorensen et al. | 81/487 |
| 5,009,134 | A | * | 4/1991 | Sorensen et al. | 81/487 |
| D320,919 | S | | 10/1991 | Sorensen | D8/72 |
| 5,161,787 | A | | 11/1992 | Hobday | 269/6 |
| 5,454,551 | A | * | 10/1995 | Hobday | 269/6 |
| 5,826,310 | A | * | 10/1998 | Hobday | 24/514 |

(Continued)

OTHER PUBLICATIONS

Bessey KlikKlamp display and sales information, date Aug. 5, 2004.

*Primary Examiner*—Lee D. Wilson
(74) *Attorney, Agent, or Firm*—Wolff Law Offices; Kevin Alan Wolff

(57) ABSTRACT

The present invention is directed generally to tools that are high quality, strong, and lightweight. For example, various tools such as clamps may be made using parts containing a compound or alloy including magnesium. Magnesium may be for cast or extruded parts. In one embodiment, an "F" style clamp may be made with one or both of the two cooperating jaw members or sections being cast from a magnesium compound or alloy. In one variation, the "F" style clamp may include a shaft made from extruded magnesium. In another embodiment, a "C" style clamp may be made with the "C" shaped frame being cast from a magnesium compound or alloy. In a further embodiment, a bar clamp having trigger indexing may me made with one or both of two jaw members or sections being cast from a magnesium compound or alloy. In a variation, the bar may be an extruded magnesium.

20 Claims, 9 Drawing Sheets

U.S. PATENT DOCUMENTS 6,708,966 B1 3/2004 Troudt ..... 269/249
6,726,193 B1 * 4/2004 Yates ..... 269/184
2003/0116901 A1 6/2003 Roesch ..... 269/6
2005/0082730 A1 * 4/2005 Murray et al. ..... 269/166

* cited by examiner

METHODS AND APPARATUS FOR CLAMPING TOOLS

This application claims priority from provisional patent application No. 60/511,660 filed on Oct. 17, 2003, the entire disclosure of which is hereby incorporated by reference as if set forth fully herein.

FIELD OF THE INVENTION

The present invention pertains to methods and various apparatus for building tools. For example, the invention involves methods and various apparatus for high quality, durable and in some case lightweight building tools.

BACKGROUND

Various work piece clamping or spreading tools have been known in the past for working with, spreading, holding and/or clamping together various work pieces or items being worked on. How to make and use such tools is generally known in the art as shown by, for example, various designs disclosed in U.S. Pat. Nos. 2,876,814; 2,947,333; 3,096,975; 3,210,070; 3,357,698; 4,132,397; 4,220,322; 4,874,155; 4,893,801; 4,926,722; 5,161,787; and 6,708,966, which are incorporated herein by reference. Some examples of typical types of clamps include the "F" style bar clamp having screw and indexing adjustments, "C" style clamps having screw adjustment, and bar clamps having trigger indexing adjustment. Traditionally the "F" style bar clamp has been made of cast iron or steel jaw parts placed along or over a steel shaft. Traditionally the "C" style clamp has been made of cast iron or steel. Traditionally the bar clamp having trigger indexing adjustment have been made of plastic or glass-filled nylon jaw parts and trigger along or over a steel bar. Work piece spreaders may be constructed of similar components and materials, but exert force pushing apart or away from one another so as to spread apart a work piece or portions thereof. Regardless, the traditional materials often make the clamps somewhat heavy in weight due to the use of steel and/or iron for strength to meet the stress and forces that the clamps and/or spreaders experience when used to hold a work item. Therefore, it is advantageous to build such clamps to be light in weight yet strong enough to withstand the stress and forces that the clamps experience when closed to hold a work item.

SUMMARY

The present invention is directed generally to tools that are high quality, strong, and lightweight. For example, various tools such as clamps and/or spreaders may be made using parts containing a compound or alloy including magnesium. Magnesium may be used to reduce the weight of the cast or extruded parts of the clamps and/or spreaders. In one embodiment, an "F" style clamp may be made with one or both of the two cooperating jaw members or sections being cast from a magnesium compound or alloy. In one variation, the "F" style clamp may include a shaft made from extruded magnesium. In another embodiment, a "C" style clamp may be made with the "C" shaped frame being cast from a magnesium compound or alloy. In a further embodiment, a bar clamp having trigger indexing may me made with all or a portion of one or both of two jaw members or sections being cast from a magnesium compound or alloy. In a variation, the bar may be made of extruded magnesium. In another embodiment, a work piece spreader may include one or more parts made from a material including magnesium.

BRIEF DESCRIPTION OF THE DRAWINGS

The objects, features and advantages of the present invention will become more readily apparent to those skilled in the art upon reading the following detailed description, in conjunction with the appended drawings, in which.

DETAILED DESCRIPTION

The present invention is directed generally to tools that are high quality, strong, durable, and lightweight. As such, the present invention includes various embodiments showing methods and various apparatus for clamps and/or work piece spreaders that may be, at least in part, made of a magnesium compound or alloy.

Figure 1:
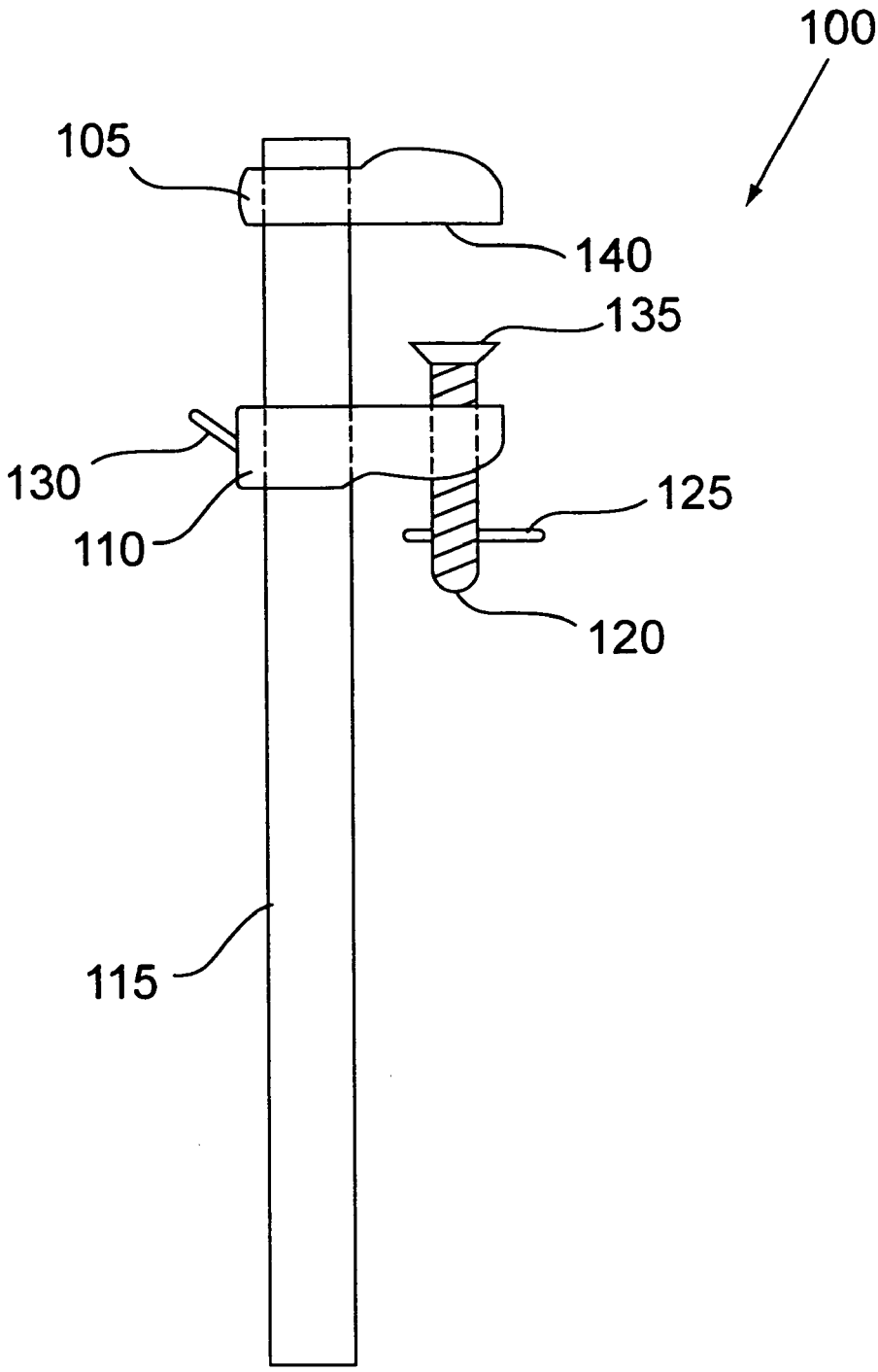
FIG. 1 illustrates an "F" style clamp, according to one embodiment of the invention.

Referring to FIG. 1, an "F" style clamp 100 is illustrated. In this embodiment, the "F" style clamp may include a first jaw member 105 and a second jaw member 110 that may be coupled to a shaft or bar 115. The shaft may be, for example, a pipe or a straight bar rectangular in shape. Further, the first jaw member 105 may be set to a fixed position on the shaft or bar 115 by, for example, being securely attached to the shaft 115 using friction, welding, screws, bolts and nuts, rivets threads, etc., so that it does not move when a work item is squeezed in the clamp. Further, the second jaw member 110 may be movable along the shaft 115 and may have a moveable indexing mechanism 130 for holding or releasing the second jaw member 110 in a particular position along the shaft 115 so as to provide he "F" style clamp with course length or distance adjustment between the first jaw member 105 and the second jaw member 110. The indexing mechanism 130 may ride against the shaft 115 with the assistance of a spring or tension member (not shown). The shaft 115 may movably fit through a hole in the second jaw member 110 and the movable indexing mechanism 130. There may also be fine adjustment for the clamp by including a threaded member 120 (like a screw or bolt) that may be turned using handle 125 that is inserted into a hole in the threaded member 120. The threaded member 120 may have a head 135 that may interface with a work item to be held in the clamp 100. The interface head 135 may be coupled to the threaded member 120 and operate in conjunction with the opposing flat surface 140 of the first jaw member 105, between which a work piece may be held or clamped. In one variation, the second jaw member 110 may be stationary on the shaft or bar 115 and the first jaw member 105 may move. In another variation, both the first jaw member 105 and the second jaw member 110 may be adjustable and be movable along the shaft or bar 115.

In one embodiment, the "F" style clamp 100 may be made with the first jaw member 105 and/or the second jaw member 110 including magnesium material. The magnesium material may be a compound or alloy and may be, for example, a cast magnesium compound piece. The magnesium compound or alloy may be made partially or primarily of magnesium (Mg) to provide light weight and have various other materials or elements so as to increase its strength and durability. In the past, it was believed that a magnesium compound or alloy was not of sufficient strength to be used in clamping or spreading devices. However, the present inventors have found that magnesium compound or alloy may be formulated to have sufficient strength for use in various clamping or spreading devices and provide lighter weight tools. For example, one magnesium compound or alloy, may include the following substances in the following amounts: Aluminum (Al) at 8.5% to 9.5%; Copper (Cu) at 0.25% maximum; Manganese (Mn) at 0.15% minimum; Nickel (Ni) at 0.01% maximum; Silicon (Si) at 0.20% maximum; Zinc (Zn) at 0.45% to 0.9%; other materials (OT) at 0.30% maximum; and Magnesium (Mg) is the % remainder. This composition of Magnesium is particular good for forming parts by casting. However, other formulations are possible, such as the formulation of the magnesium alloy may vary within the above by +/−5% for Al and Mg, and +5% for Mn.

Using the aforementioned formulation, it has been found that, for example, an "F" style clamp with one or more jaws made of magnesium may have a strength sufficient to withstand a clamping or spreading force of, for example, approximately 3 kN (killo-Newtons) or greater without breaking or fracturing under the force of the clamp, using a US type of test setup. In this type of testing, it has been shown that a clamp having two jaws made of the aforementioned magnesium compound can withstand approximately 3.3 kN of clamping force for up to four hours without breaking, fracture or signs of fatigue. The "F" clamp according to the invention using this test setup has been shown to achieve a maximum force capability of approximately 4 kN before experiencing degradation. Further, the clamp or spreader when using a European type test setup may withstand approximately 5 kN of clamping or spreading force without breaking or fracturing. In this type of testing, it has been shown that a clamp having two jaws made of the aforementioned magnesium compound can withstand approximately 5.3 kN of clamping force for up to six hours without breaking, fracture or signs of fatigue. The "F" clamp according to the invention using this test setup has been shown to achieve a maximum force capability of approximately 6 kN before experiencing degradation. Similar type of strength performance may be shown for other types of clamps and spreaders using the aforementioned magnesium compound or similar magnesium compounds.

In one variation, the "F" style clamp 100 may have a shaft, pipe or bar 115 that includes Magnesium. The shaft or bar 115 may include a compound or alloy of magnesium material and may be, for example, an extruded magnesium compound piece. The magnesium compound or alloy may be made partially or primarily of magnesium (Mg) to provide light weight and have various other materials or elements so as to increase its strength and durability. For example, one magnesium compound or alloy particularly well suited to extrusion may include the following substances in the following amounts: Aluminum (Al) at 2.5% to 3.5%; Copper (Cu) at 0.05% maximum; Iron (Fe) at 0.005% maximum; Manganese (Mn) at 0.20% minimum; Nickel (Ni) at 0.005% maximum; Silicon (Si) at 0.30% maximum; Zinc (Zn) at 0.60% to 1.4%; Calcium at 0.3% maximum; other materials (OT) at 0.30% maximum; and Magnesium (Mg) is the % remainder. This composition of Magnesium is particular good for forming parts by extrusion. The formulation may have variations from those above, for example, the composition of magnesium may vary within the above by +/−5% and Mg, −2.5% to 5% for Al and +5% for Mn. In another variation, the shaft or bar 115 may be formed from casting rather than extrusion. Although, the shaft or bar 115 may be made of, for example, aluminum, iron, steel, etc., along with other straight parts.

Figure 2A:
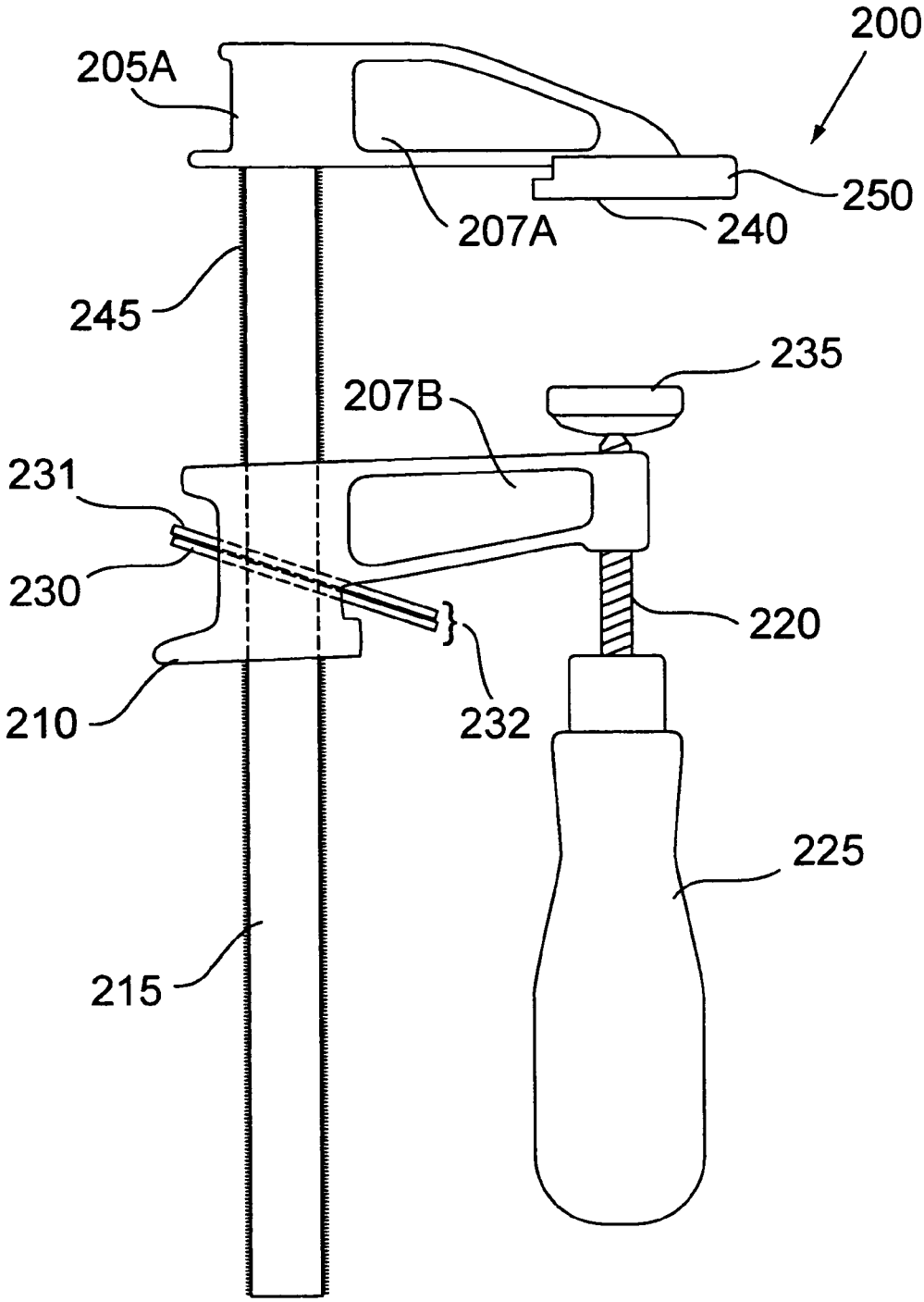
FIG. 2A illustrates an "F" style clamp, according to another embodiment of the invention.

It is understood that the "F" style clamp may have various different shaped jaws or shafts and still utilize the unique properties of the present invention. For example, another embodiment of an "F" clamp design is show in FIG. 2A. In this embodiment, the "F" style clamp is similar to the "F" style clamp shown in FIG. 1 with a number of differences. For example, a first jaw 205 may be constructed differently to have a void area 207A and a second jaw 210 may be construed having a void area 207B to further reduce the weight of the jaws when used with a magnesium compound or alloy. In this case, the first jaw 205A may have a single work piece interface surface 240. Further, the first jaw 205 may have a pad 250 made of a resilient material, for example a plastic or rubber material, to interface with a surface of a work piece that is held between the jaws of the clamp. Similarly, the head 235 may also include a flexible resilient material that contacts a surface of a work piece. A handle 225 may also be attached to a threaded member 220, for making fine adjustment to the pressure applied to a work piece. The shaft, pipe or bar 215 may also include a roughened surface 245 to improve the holding strength between the jaw 210 and the shaft 215, that may be made of a magnesium compound or alloy. In addition the moveable indexing mechanism 232 may include two plates or sections 230 and 231 for holding or releasing the second jaw member 210 and extend through a through hole in the second jar member 210 so as to extend on both sides. In this case, the movable indexing mechanism 232 may be activated from two sides of the second jaw member 210. The indexing mechanism 232 may ride against the shaft 215 with the assistance of a spring or tension member (not shown).

Figure 2B:
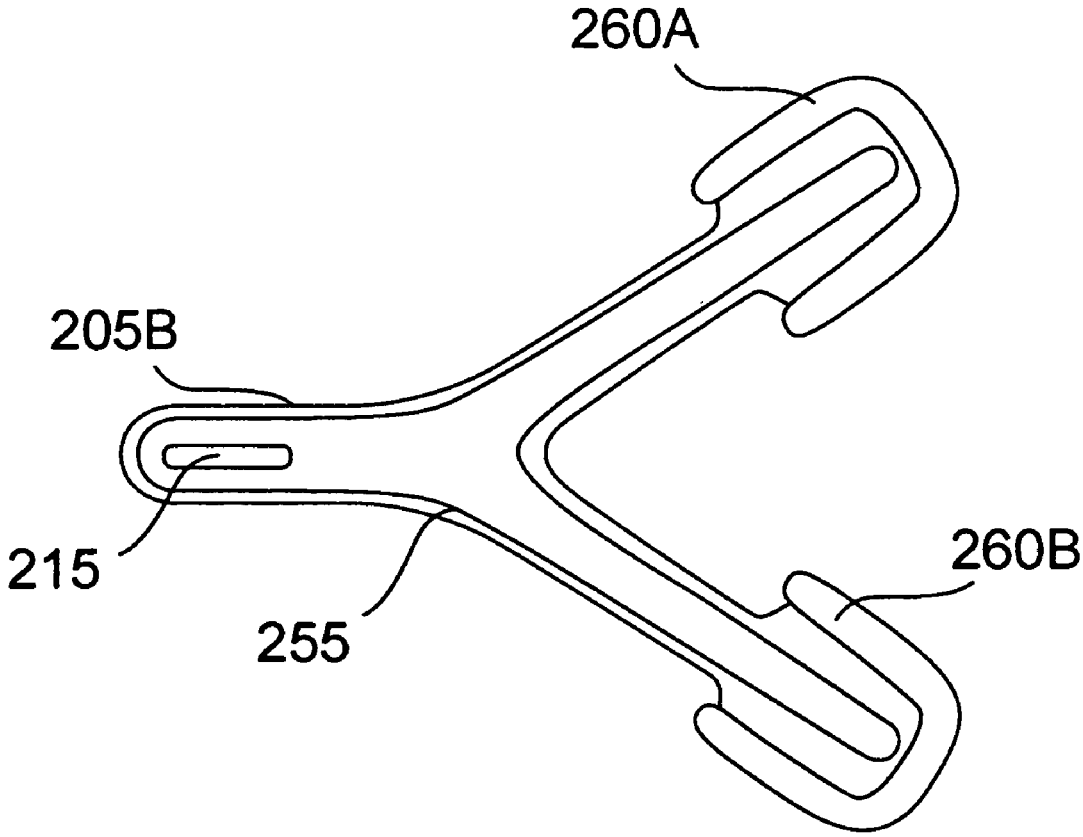
FIG. 2B illustrates a portion of an "F" style clamp, according to a still further embodiment of the invention.

Referring to FIG. 2B, a top view of a different type of jaw useful for clamps and/or spreaders is shown. In this case there are two separate arms to the jaw 205B having work piece interface pads 260A and 260B. The jaw 255 may also have an angle iron type shape having material with an L shape to improve strength of the two arm jaw 205B. The pads 260A and 260B may include a resilient and/ or flexible material such as rubber or plastic. The jaw 255 may be attached then to the shaft 215.

Figure 3:
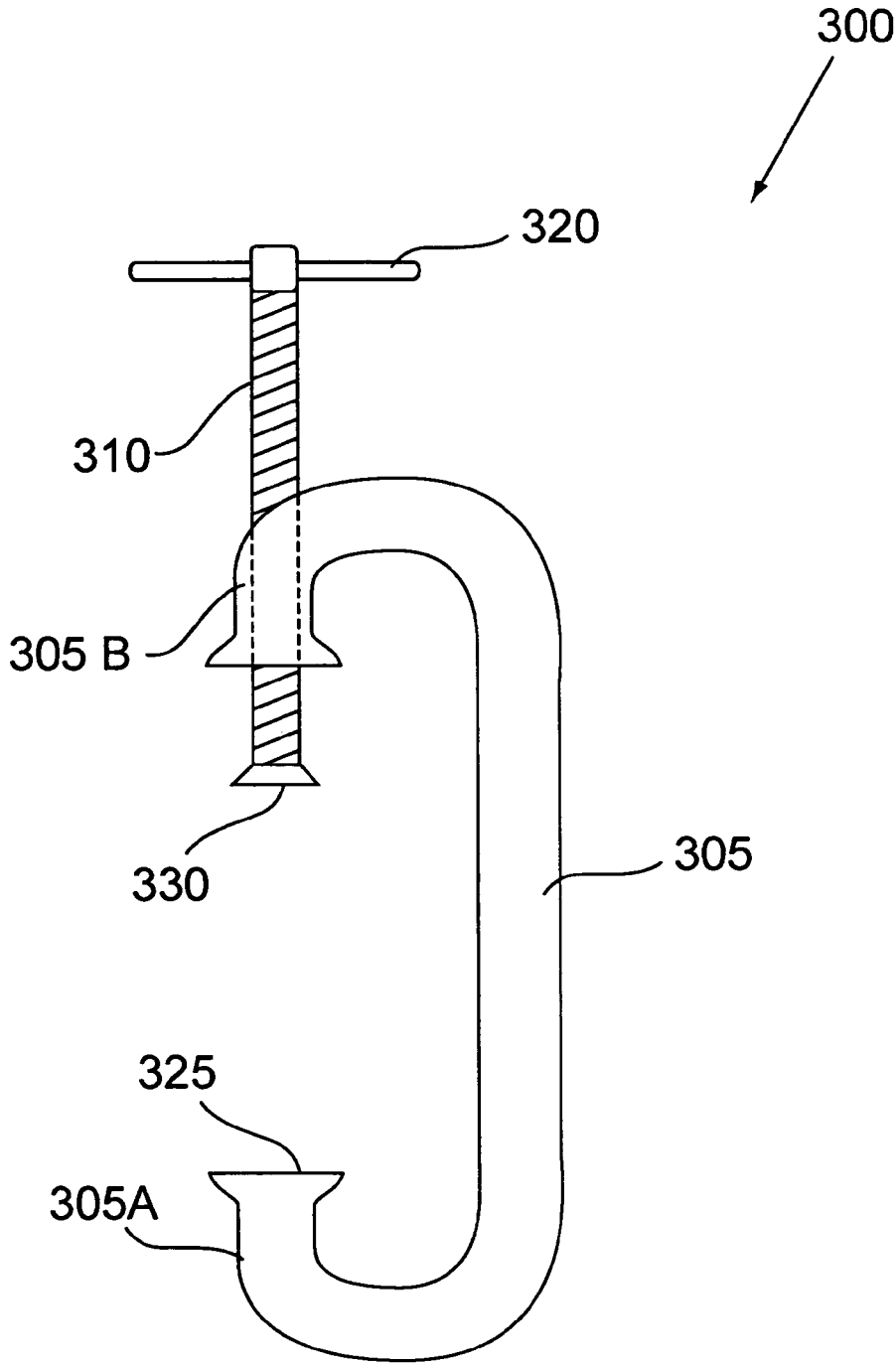
FIG. 3 illustrates a "C" style clamp, according to one embodiment of the invention.

Referring now to FIG. 3, one embodiment of a "C" style clamp is illustrated. The "C" clamp may include jaws 305 having a first jaw member 305A and a second jaw member 305B integrally formed with an elongated shafts section to form the shape of a "C." The integral jaws 305 (including 305A and 305B) may be formed of a Magnesium compound similar to the Magnesium compound used for making the "F" style clamp of FIG. 1. In one variation, one or more sections of the jaws 305 may be formed of a Magnesium compound or alloy using, for example, a casting process. Further, the "C" style clamp includes a threaded member 310 that may be threaded through a threaded hole in second jaw member 305B. A handle member 320 may be coupled to the threaded member 310 through a hole in one end of the threaded member 310. An interface head may be coupled to the opposite end of the threaded member 310. The "C" style clamp may have only one means of adjustment; by turning the handle member 320 and thereby the threaded member 310 the interface head may apply pressure to a work piece situated between first jaw member 305A and the threaded member 310 with interface head. The various portions of the "C" clamp 300 may be made of a magnesium compound or alloy such as those described above for the "F" clamps or similar compounds, to reduce the weight of the clamp and may be capable of supporting a clamping force of approximately 3 kN or greater, or approximately 5 kN or greater, without breaking or fracturing.

Figure 4:
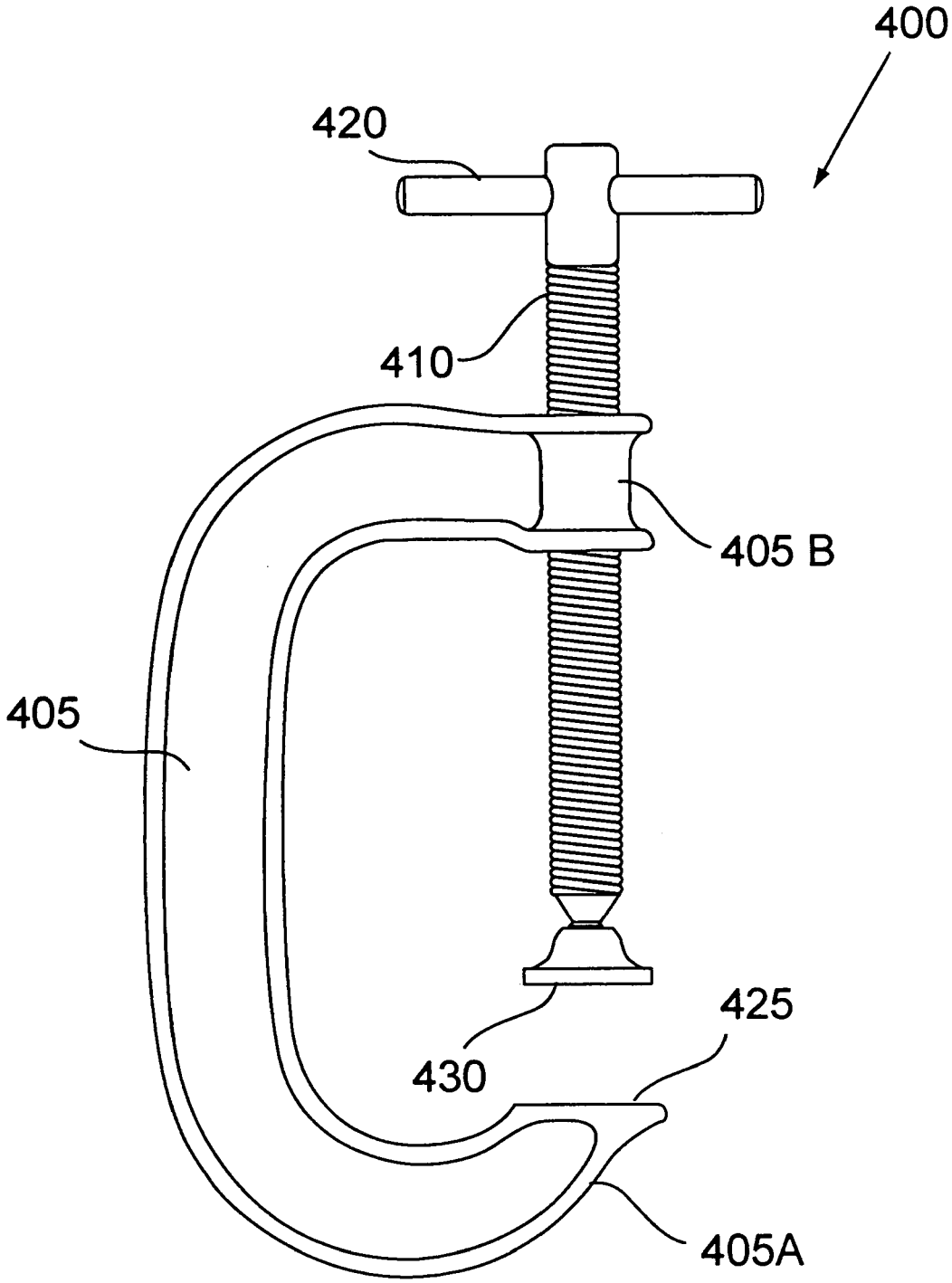
FIG. 4 illustrates a "C" style clamp, according to another embodiment of the invention.

Referring now to FIG. 4, another embodiment for a "C" clamp is shown. This "C" clamp is similar to the earlier described "C" clamp in most respects, however, the design is different in a number of ways. For example, the C shaped frame 405 has only one end shaped in a curve that looks like a C, end 405A, while the other end 405B is not curved much. As a result, the C shape of the clamp 400 is complete by a portion of the threaded member 410. Further, in this embodiment, the strength of the light weight magnesium frame can be increased by including an angle iron ribs around the perimeter of the clamp frame 405. Again, a work piece may be coupled between surface 425 and 430 by turning the threaded member 410 using the handle member 420. Further, the various portions of the "C" clamp 400 may be made of a magnesium compound or alloy such as those described above for the "F" clamps (or similar magnesium compounds), to reduce the weight of the clamp, and may be able to withstand a clamping force of approximately 3 kN or greater, or approximately 5 kN or greater, without breaking or fracturing.

Figure 5:
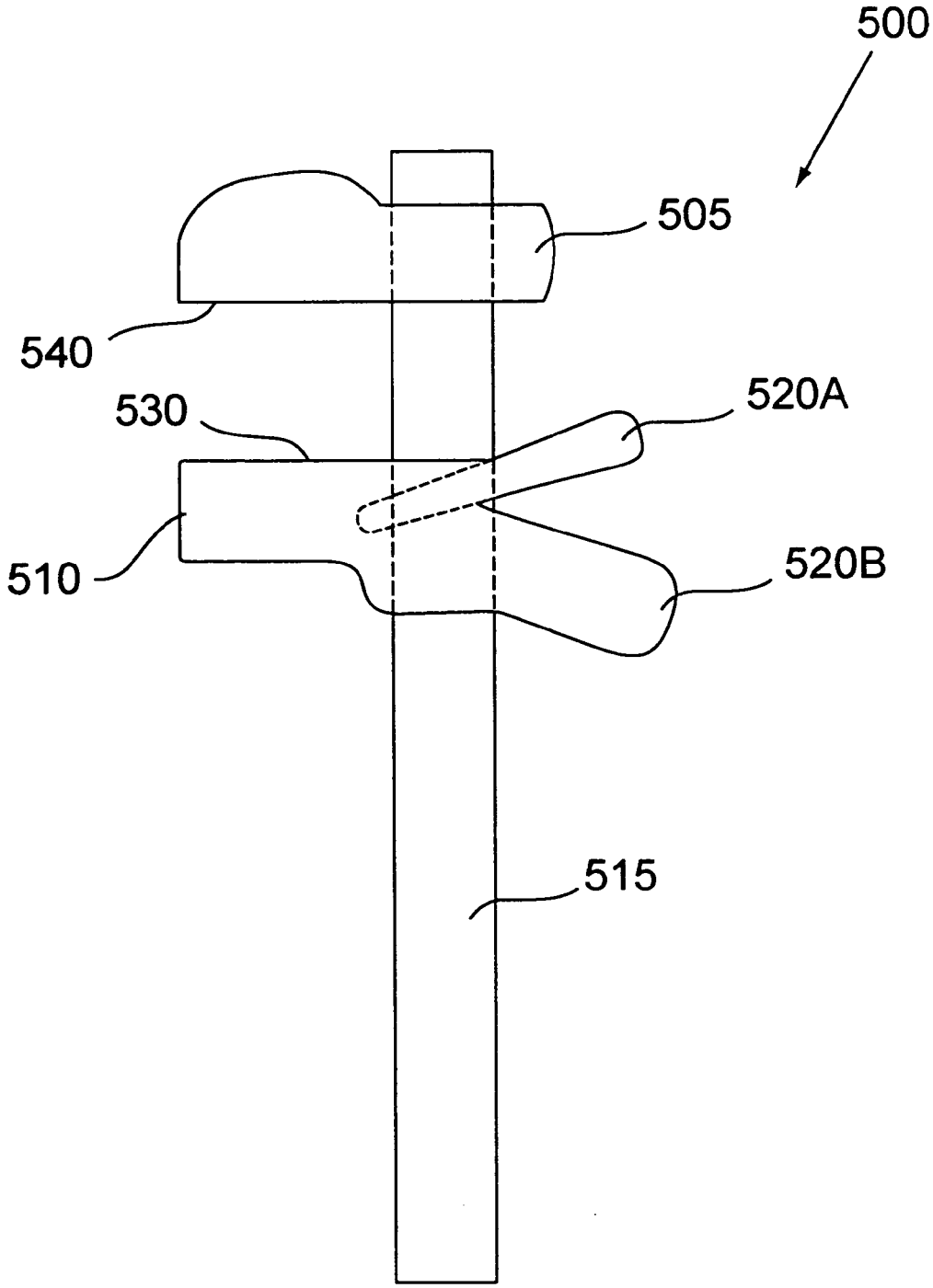
FIG. 5 illustrates a bar style clamp with trigger indexing, according to one embodiment of the invention.

Referring now to FIG. 5, a trigger indexing bar clamp 500 is illustrated. In this embodiment, the trigger indexing bar clamp may include a first jaw member 505 and a second jaw member 510 that may be coupled to a shaft or bar 515 by, for example, a hole in the jaw members. The shaft 515 is preferably a bar but may be, for example, a pipe or other rigid elongated shape. Further, the first jaw member 505 may be set to a fixed position on the shaft or bar 515 by, for example, being securely attached to the shaft 515 using friction, welding, screws, bolts and nuts, rivets threads, etc., so that it does not move when a work piece or item is squeezed in the clamp. In one variation, the first jaw member may be movable and adjustable along the shaft 515. Further, the second jaw member 510 may be movable along the shaft 515 by the assistance of an indexing mechanism 520 including, for example, a pumping trigger 520B for moving second jaw member 510 towards first jaw member 505 to hold a work piece and a hold and release trigger 520A for holding the second jaw member 510 in a particular position along the shaft 515 and releasing the second jaw member when wishing to release a work piece. In the trigger indexing bar clamp 500 the pumping trigger 520B and hold and release trigger 520A provide the only mechanism for moving the second jaw member 510.

Various portions of the trigger indexing bar clamp 500 may be made of material including magnesium so that it reduces the weight of the clamp yet still has the strength necessary to be used in various applications as a clamp without fracturing, fatiguing, or breaking. In one variation the material make up of at least some of the parts are a compound or alloy including magnesium, such as the magnesium compounds or alloys described above with reference to the "F" style clamp, and similar compounds or alloys. The magnesium may be used for cast or extruded parts. In one variation, the first jaw member 505 may be made of cast magnesium compound or alloy and one or more of the second jaw member 510, pumping trigger 520B and hold and release trigger 520A may be made of cast magnesium compound or alloy. In one variation, the trigger indexing bar clamp may include a shaft or bar 515 made from extruded magnesium. Although, the shaft or bar 515 may be made of, for example, aluminum, iron, steel, etc., along with various other parts.

Figure 6:
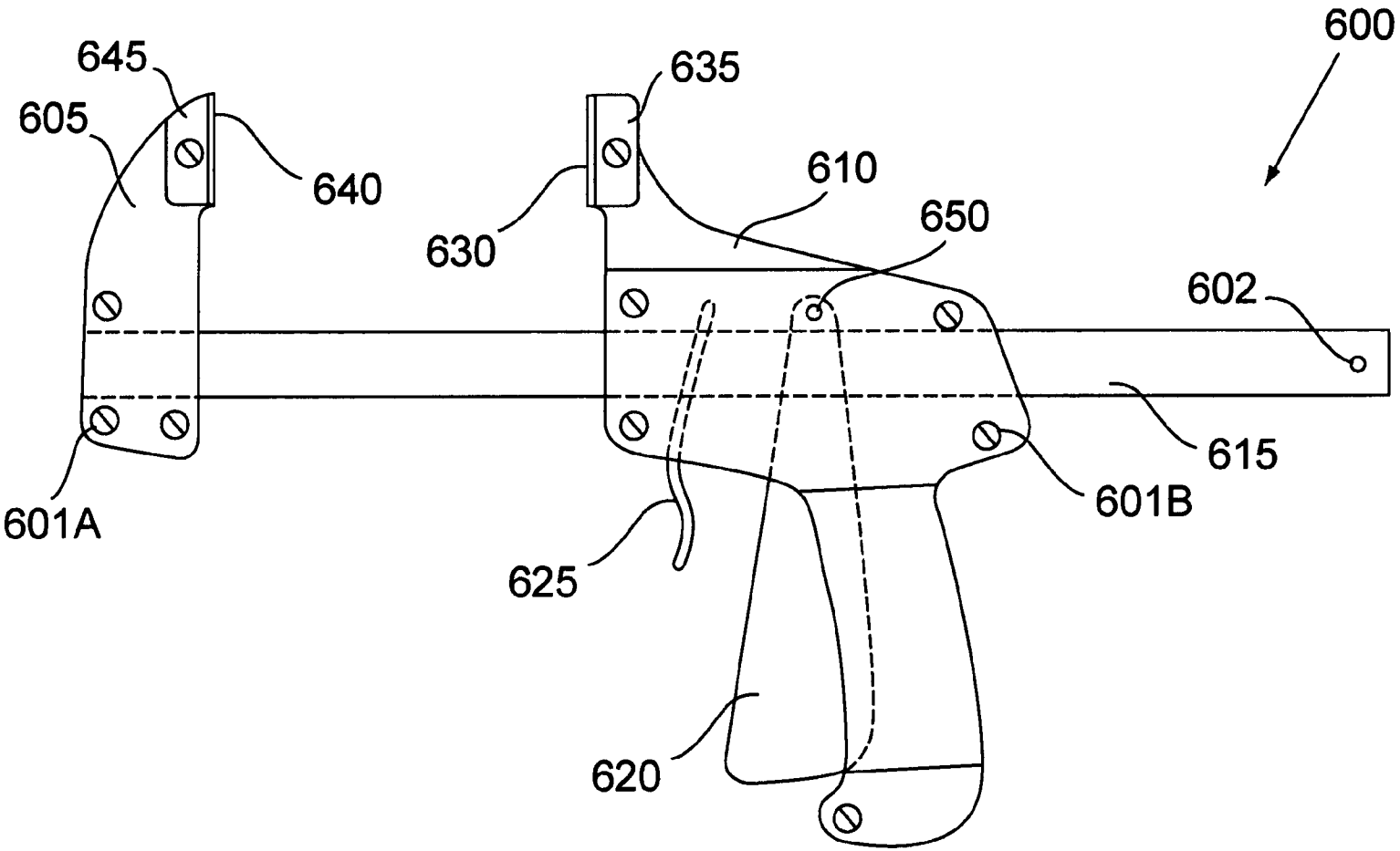
FIG. 6 illustrates a bar style clamp with trigger indexing, according to another embodiment of the invention.

Referring to FIG. 6, another type of trigger indexing clamp is shown. Trigger indexing clamp 600 is similar to the trigger clamp 500 and may include a first jaw member 605, but it may be made in two sections (one side shown) that are held together by bolts or screws 601A. In this manner, the first jaw may be moved along the shaft 615 by loosening the bolts or screws 601A, relocating the first jaw at another location on the shaft 615, and then tightening the bolts or screws. The first jaw member 605 may also have a separate piece 645 couple to it so as to provide the contact surface 640. The second jaw member 610 may also be made of two parts (one shown) held together with bolts or screws 601B and may include a pumping or stepping trigger 620 that inserts into a handle portion of the second jaw member 610 and pivots on a pin 650. The trigger 620 may be forced into a resting position via a spring mechanism (not shown). When the trigger 620 is moved toward the handle of the second jaw member 610, the second jaw member 610 will move along the shaft 615 toward the first jaw member 605. The second jaw member 610 may also include a release trigger 625 that may be pressed to release the second jaw member 610 so that it may be moved along the shaft 615 freely in either direction, toward or away from the first jaw member 605. The second jaw member 610 may also have a separate piece 635 couple to it so as to provide the contact surface 630. A stop pin 602 may also be place on one end of the shaft 615.

Various portions of the trigger indexing bar clamp 600 may be made of material including magnesium so that it reduces the weight of the clamp yet still has the strength necessary to be used in various applications as a clamp without fracturing, fatiguing, or breaking. In one variation the material make up of at least some of the parts are a compound or alloy including magnesium, such as the magnesium compounds or alloys described above with reference to the "F" style clamp, and similar compounds or alloys. The magnesium may be used for cast or extruded parts. In various variations, the first jaw member 605 may be made of cast magnesium compound or alloy and one or more of the second jaw member 610 with handle, pumping trigger 620 and/or hold and release trigger 625 may be made of cast magnesium compound or alloy. In one particular variation, the first jaw 605 and second jaw 610 may be made of a cast magnesium compound while the trigger 620 may be made of a hard plastic. In one variation, the trigger indexing bar clamp 600 may include a shaft or bar 615 made from extruded magnesium. Although, the shaft or bar 615 may be made of, for example, aluminum, iron, steel, etc., along with various other parts.

Figure 7:
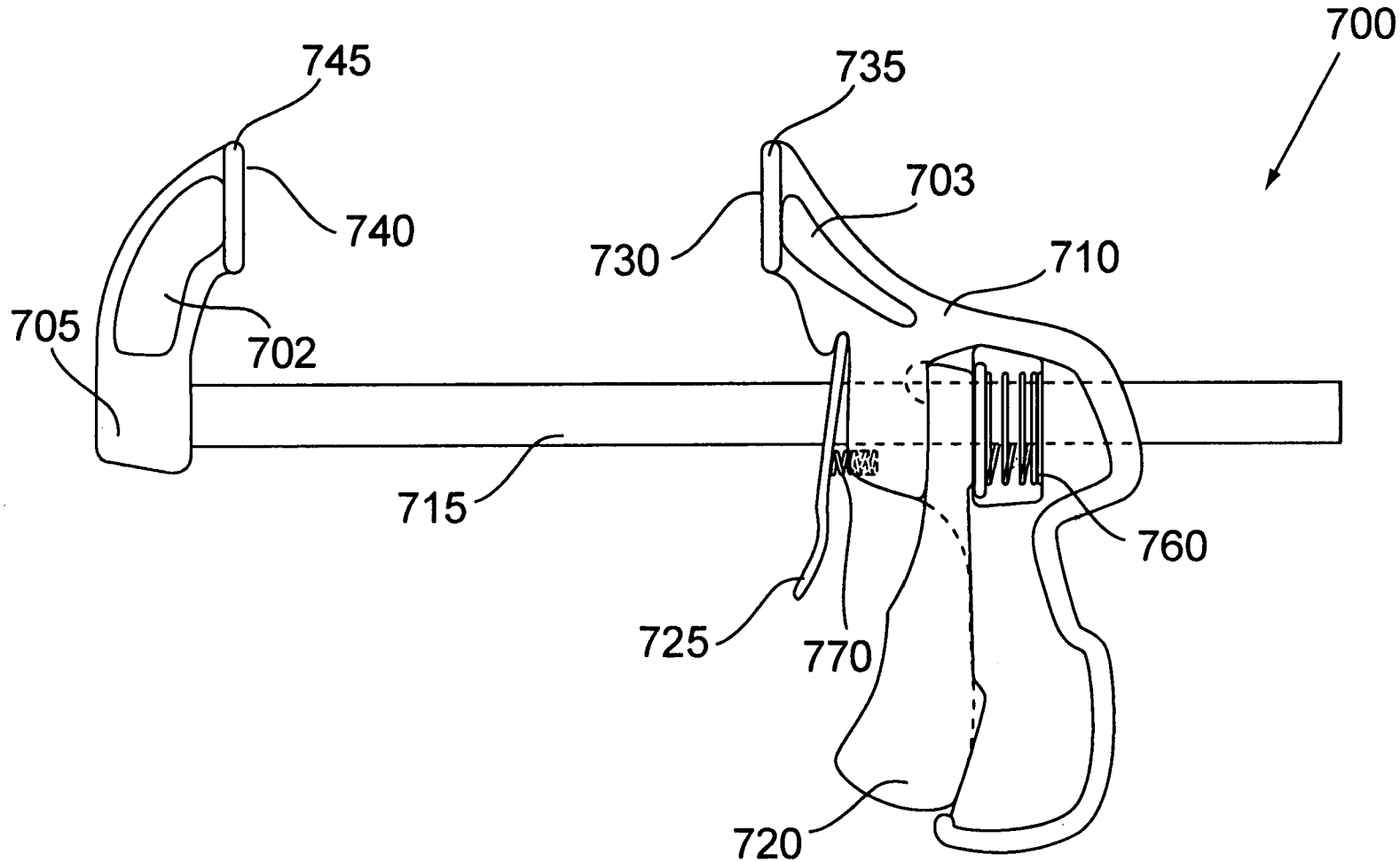
FIG. 7 illustrates a bar style clamp with trigger indexing, according to another embodiment of the invention.

Referring now to FIG. 7, another version of a trigger indexing bar clamp 700 is shown. This trigger indexing bar clamp 700 is similar to the trigger indexing bar clamp 600, but may have a solid piece for the first jaw member 705 with a sunken hallowed out area 702 surrounded by ribs and a solid piece for the second jaw member 710 with a sunken hallowed out area 703 surrounded by ribs. The hallowed out areas 702 and 703 may help to reduce weight of the clamp and the ribs may help improve the strength of the clamp. Pad 745 and/or work piece contact surface 740 and pad 735 and/or work piece contact surface 730 may be of a flexible resilient material, such as rubber. The pumping or stepping trigger 720 may be formed to go around the sides of the second jaw member 710 handle portion (i.e., the trigger 720 is wider than the handle portion). In this embodiment, the spring member 760 is shown to apply pressure to the back of the trigger 720 so that it returns to its normal position after being pressed and released. The release trigger 725 in this embodiment is almost entirely external to the second jaw member 710, except for a portion of its tension spring member. Of course, various parts of this clamp may be made of a magnesium compound or alloy to reduce weight of the clamp while achieving a strength sufficient to withhold a clamping force of approximately 3 kN or greater, or approximately 5 kN or greater, without breaking or fracturing. In one particular variation, the first jaw 705 and second jaw 710 may be made of a cast magnesium compound while the trigger 720 may be made of a hard plastic.

Figure 8:
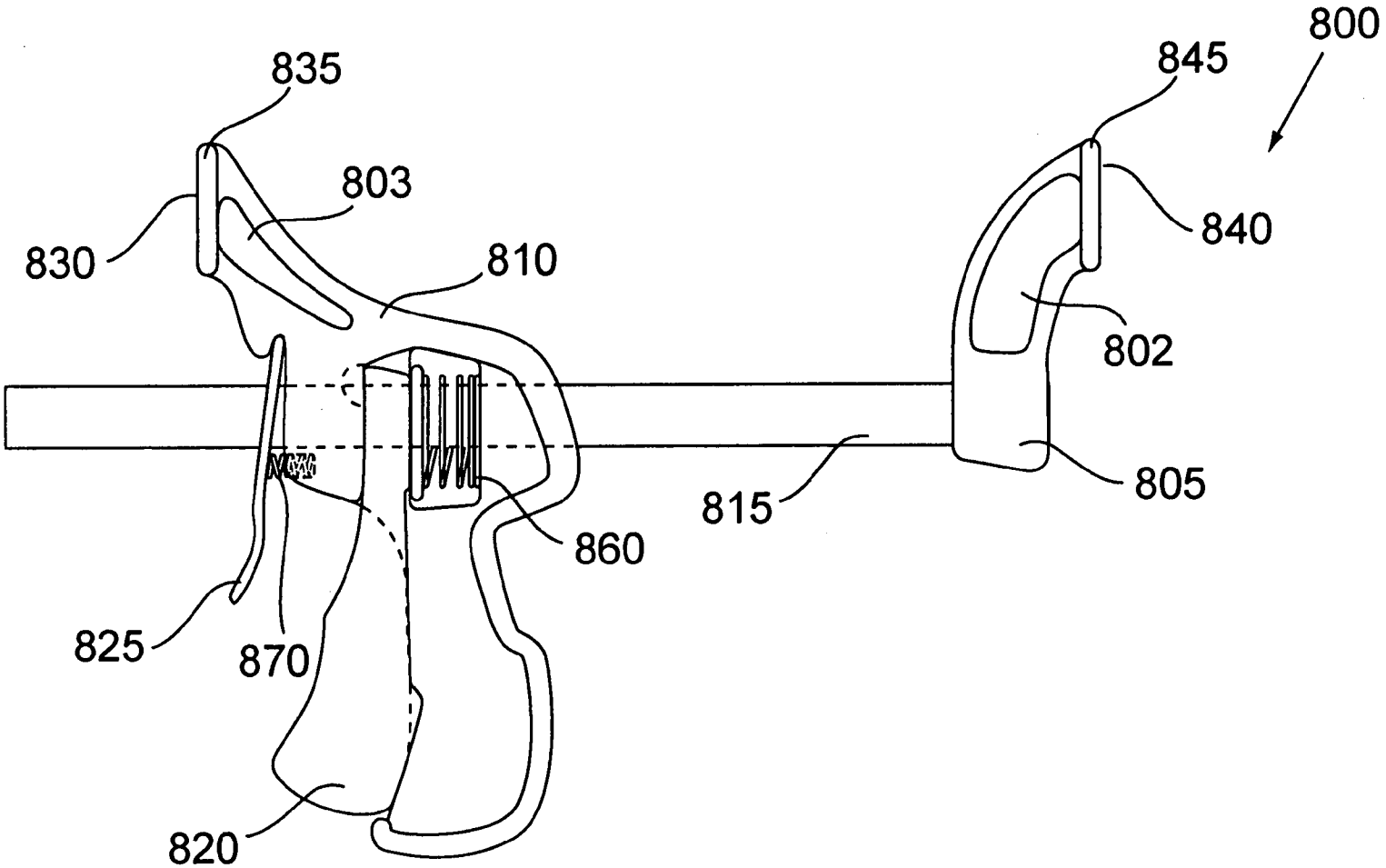
FIG. 8 illustrates a bar style work piece spreader with trigger indexing, according to one embodiment of the invention.

Most of the aforementioned "F" style clamps and trigger indexing bar clamps may be configured to be operated as a work piece spreader by turning the jaw and the work piece contact surfaces in opposite directions so that a force can be applied in away from one another rather than toward one another. Referring to FIG. 8, a modified clamp similar to clamp 700 shown in FIG. 7 is used to illustrate on version of a work piece spreader 800. In this case, a first jaw member is facing outward from the shaft 815 and second jaw member 810. As shown, in this embodiment the work piece contact surfaces 830 and 840 are facing in opposite directions so that they may be used to spread a work piece. As with the aforementioned clamps, the spreader 800 may have various parts made of a magnesium compound or alloy to reduce weight of the clamp while achieving a strength sufficient to withhold a spreading force of approximately 3 kN or greater, or approximately 5 kN or greater, without breaking or fracturing. In one particular variation, the first jaw 805 and second jaw 810 may be made of a cast magnesium compound while the trigger 820 may be made of a hard plastic.

Although a particular embodiment(s) of the present invention has been shown and described, it will be understood that it is not intended to limit the invention to the preferred embodiment(s) and it will be obvious to those skilled in the art that various changes and modifications may be made without departing from the spirit and scope of the present invention. Thus, the invention is intended to cover alternatives, modifications, and equivalents, which may be included within the spirit and scope of the invention as defined by the claims. For example, forming various parts of other clamp or spreader designs or styles using a magnesium compound or alloy may be alternative embodiments of the present invention. For example, the lever clamp design disclosed in U.S. Patent Application Publication No. 2003/0116901 may be modified to include portions made of a magnesium compound or alloy as described herein.

Of course, the present invention may also prove to be useful with other tools that would benefit from being light in weight yet strong when forces are exerted on them. Some of the other applications for light weight yet strong might include other hand tools such as pliers, channel locks, vise grips, wrenches, etc. Other tools might include a vise, press, cutting shears, etc.

All publications, patents, and patent applications cited herein are hereby incorporated by reference in their entirety for all purposes.

What is claimed is:

1. An apparatus, comprising:

a bar style clamping or spreading tool a first jaw member made of a magnesium compound;

a slide bar;

a second jaw member made of a magnesium compound, wherein the magnesium compound withstands clamping or spreading forces without fracturing.

2. The apparatus of claim 1, wherein the first jaw member of the bar style clamping or spreading tool is a fixed jaw.

3. The apparatus of claim 2, wherein a second the bar style clamping or spreading tool further includes a trigger handle.

4. The apparatus of claim 1, further including a hold and release trigger member.

5. The apparatus of claim 3, wherein the bar style clamping or spreading tool is an "F" style clamp.

6. The apparatus of claim 3, wherein the bar style clamping or spreading tool is an indexing trigger bar clamp.

7. The apparatus of claim 3, wherein the second jaw member has two or more work piece contact pads or surfaces.

8. The apparatus of claim 2, wherein the first jaw member has two or more work piece contact pads or surfaces.

9. The apparatus of claim 1, wherein the slide bar of the bar style clamping or spreading tool is made of a magnesium compound.

10. The apparatus of claim 1, wherein the bar style clamping or spreading tool is constructed such that when applying the maximum force of 3 kN or greater it does not break or fracture.

11. The apparatus of claim 1, wherein the first jaw member of the bar style clamping or spreading tool is made of a cast magnesium compound.

12. The apparatus of claim 1, wherein the second jaw member of the bar style clamping or spreading tool is made of a cast magnesium compound.

13. The apparatus of claim 1, wherein the magnesium compound includes substances in amounts of Aluminum (Al) at 8.5% to 9.5%, Copper (Cu) at 0.25% maximum, Manganese (Mn) at 0.15% minimum, Nickel (Ni) at 0.01% maximum, Silicon (Si) at 0.20% maximum, Zinc (Zn) at 0.45% to 0.9%, other materials (OT) at 0.30% maximum, and Magnesium (Mg) is % remainder.

14. The apparatus of claim 1, wherein the magnesium compound includes substances in amounts of Aluminum (Al) at 2.5% to 3.5%; Copper (Cu) at 0.05% maximum; Iron (Fe) at 0.005% maximum; Manganese (Mn) at 0.20% minimum; Nickel (Ni) at 0.005% maximum; Silicon (Si) at 0.30% maximum: Zinc (Zn) at 0.60% to 1.4%; Calcium at 0.3% maximum; other materials (OT) at 0.30% maximum; and Magnesium (Mg) is % remainder.

15. The apparatus of claim 1, wherein the bar style clamping or spreading tool has a magnesium compound that withstands clamping or spreading forces of approximately 5 kN or greater.

16. A clamping or spreading tool, comprising:

a first jaw member made of a cast metal including magnesium compound;

a second jaw member made of a cast metal including magnesium compound; and an interconnecting bar made of a metal material and along which at least one of first jaw member and the second jaw member slide, wherein the clamping or spreading tool is constructed such that when applying the maximum force it does not break or fracture.

17. The clamping or spreading tool of claim 16, wherein the cast metal contains from approximately equal to 88.69% magnesium to approximately equal to 95.9% magnesium.

18. The clamping or spreading tool of claim 16, wherein the interconnecting bar member is extruded and contains from approximately equal to 83.94% magnesium to approximately equal to 99.92% magnesium.

19. The apparatus of claim 18, wherein the clamping or spreading tool has a magnesium compound that withstands clamping or spreading forces of approximately 3 kN or greater.

20. An apparatus, comprising:

a "C" style clamp including:

a first jaw member made of a cast metal including a magnesium compound;

a second jaw member made of a cast metal including a magnesium compound; and an interconnecting member integrally formed with the first jaw member and the second jaw member together so as to form the shape of a C, wherein the clamping or spreading tool including magnesium is constructed such That when applying a predetermined maximum clamping or spreading force the apparatus does not break or fracture.

* * * * *

UNITED STATES PATENT AND TRADEMARK OFFICE

CERTIFICATE OF CORRECTION

PATENT NO. : 7,093,828 B2
APPLICATION NO. : 10/965958
DATED : August 22, 2006
INVENTOR(S) : Scott A. Murray and Sun Xiao Wei It is certified that error appears in the above-identified patent and that said Letters Patent is hereby corrected as shown below:

In the References Cited section of the Title page, the reference listed as cited "4,786,124 A * 11/1988 Stone et al. ..... 359/15" should read as follows:

--4,786,214 A * Schmidt et al. ..... 405/303--

Signed and Sealed this

Seventh Day of August, 2007

JON W. DUDAS
*Director of the United States Patent and Trademark Office*